US007086818B2

(12) United States Patent
Pruteanu et al.

(10) Patent No.: US 7,086,818 B2
(45) Date of Patent: Aug. 8, 2006

(54) FULL-EJECT AUTOMATED SIDE/FRONT LOADING COLLECTION VEHICLE

(75) Inventors: Claudiu D. Pruteanu, Claremont, MN (US); Randall L. Bice, Rochester, MN (US)

(73) Assignee: McNeilus Truck and Manufacturing, Inc., Dodge Center, MN (US)

( * ) Notice: Subject to any disclaimer, the term of this patent is extended or adjusted under 35 U.S.C. 154(b) by 399 days.

(21) Appl. No.: 10/611,537

(22) Filed: Jul. 1, 2003

(65) Prior Publication Data

US 2005/0002764 A1 Jan. 6, 2005

(51) Int. Cl.
*B65F 3/04* (2006.01)

(52) U.S. Cl. ..... 414/406; 414/408; 414/917

(58) Field of Classification Search ..... 414/406, 414/408, 547, 421, 812, 917
See application file for complete search history.

(56) References Cited

U.S. PATENT DOCUMENTS

| | | | | |
|---|---|---|---|---|
| 4,091,944 | A * | 5/1978 | Gollnick | 414/407 |
| 5,360,310 | A * | 11/1994 | Jones et al. | 414/409 |
| 5,720,589 | A | 2/1998 | Christenson et al. | |
| 5,765,985 | A | 6/1998 | Johnson et al. | |
| 5,769,592 | A | 6/1998 | Christenson | |
| 5,857,822 | A | 1/1999 | Christenson | |
| 5,931,628 | A | 8/1999 | Christenson | |
| 5,967,731 | A | 10/1999 | Brandt | |
| 6,123,497 | A | 9/2000 | Duell et al. | |
| 6,761,523 | B1 * | 7/2004 | Hund et al. | 414/408 |

OTHER PUBLICATIONS

Communication Relating to the Results of the Partial International Search Report and Invitation to Pay Additional Fees dated Nov. 11, 2004.
Notification Concerning Transmittal of Copy of International Prelmiinary Report on Patentability Dated Jan. 12, 2006 and a copy of the International Preliminary Report on Patentability.

* cited by examiner

*Primary Examiner*—Eileen D. Lillis
*Assistant Examiner*—Charles A. Fox
(74) *Attorney, Agent, or Firm*—Nikolai & Mersereau, P.A.; C. G. Mersereau

(57) ABSTRACT

A refuse collection vehicle for loading, compacting, transporting and ejecting refuse materials is disclosed including a hollow refuse storage enclosure having a forward refuse receiving opening, and a rear refuse discharge opening closed by a tailgate. A generally full width charging hopper is located forward of the storage enclosure for receiving refuse from refuse containers, the charging hopper having sidewalls and a floor and being in communication with the storage enclosure. A variable stroke followerless packer-ejector panel mechanism is provided to move refuse materials to the sweep charging hopper, pack the refuse materials into the storage enclosure and fully eject the refuse materials from the storage enclosure. The truck body accommodates one or more container handling devices selected from narrow profile side-loading and front-loading container handling devices or a combination thereof for emptying containers into the charging hopper. A control system is provided for controlling the stroke operation of the packer-ejector panel in relation to the container handling device and eliminate the need for a follower regardless of collection container density.

26 Claims, 11 Drawing Sheets

FULL-EJECT AUTOMATED SIDE/FRONT LOADING COLLECTION VEHICLE

BACKGROUND OF THE INVENTION

I. Field of the Invention

The present invention relates generally to refuse vehicles, particularly to dedicated side-loading, or front loading, rear discharging refuse vehicle bodies designed for automated loading by container handling devices. The invention further relates to incorporating packer-ejector mechanisms which feature a relatively high speed packing phase and which provide full ejection of the packed contents of the storage enclosure of the truck body without any tipping of the truck body to discharge refuse. A charging or receiving hopper is provided located forward of the storage enclosure to facilitate automated loading using an associated short-radius boom-mounted container handling mechanism, or alternately, a front loading fork and arm system may be substituted. The relatively high speed reciprocating packer panel cycle moves refuse from the receiving hopper into a vehicle body storage enclosure through a front opening accessed from the hopper at a speed that eliminates the need for a follower panel.

II. Related Art

Refuse hauling trucks commonly include a hollow truck body dedicated to receiving, compacting, discharging refuse materials mounted on a heavy duty chassis which includes a cab. The truck body generally includes all the associated hydraulic, pneumatic and/or electrical operating mechanisms associated with packing and ejection equipment. In side-loading or front-loading systems, the truck cab is located in front of a receiving hopper which charges a rear storage enclosure. Refuse to be hauled is loaded into the receiving hopper as by dumping containers either manually or by using a mechanized container handling device mounted on the charging hopper, truck chassis or body. A packing device including a reciprocating or rotating ram, usually hydraulically operated, compacts the material moving it rearward into the storage enclosure or compartment. Loading of the charging hopper is accomplished through side or top openings. The bottom or floor of the charging hopper typically is located at a height equal to or above that of the storage enclosure.

It is known to provide a front or side loading refuse vehicle with a packing and ejecting mechanism that packs refuse from a charging hopper into an associated hollow storage enclosure and later fully ejects the refuse from the storage enclosure. An example of such a refuse truck body system is shown in U.S. Pat. No. 5,857,822. A further type of full-eject side loading refuse vehicle is shown in co-pending application Ser. No. 10/414659, filed Apr. 16, 2003, which is assigned to the same Assignee as the present application. That system includes a charging hopper floor that is dropped to accommodate manual loading and packs the storage compartment from beneath utilizing a vertically pivoting packer-ejector assist panel to clear the dropped or lowered floor area during ejection and optionally to assist the packing, if desired.

It is also known to provide a mechanized lifting and emptying apparatus situated on one side of the receiving hopper such that a container of interest may be retrieved on that side and emptied through a material receiving opening into the receiving hopper. Such an apparatus typically includes a holding or grasping device generally connected to an arm or extensible boom which is connected, in turn, to a base mounted on the vehicle. The arm or boom and grasping device are operated in concert to engage the container of interest, lift and dump the container into the receiving hopper in the vehicle. Such systems are typically operated using one or more hydraulic devices to extend or retract the boom, pivot the arm and open and close the grabbing device. Examples of such booms are shown in U.S. Pat. Nos. 5,967,731, 5,769,592 and 5,931,628.

While the prior devices of the related art have met with a certain amount of success, there remains a definite need for a refuse collection truck body that offers automated side or front loading in which the packer mechanism is constructed and operated in a manner which eliminates the need for a follower panel and which includes a full ejection mechanism which allows full emptying of the storage chamber of the truck body without the need for tipping.

SUMMARY OF THE INVENTION

By means of the present invention, there is provided a refuse collection vehicle body for loading, compacting, transporting and ejecting refuse materials. The truck body includes a hollow refuse storage enclosure for containing collected and compacted refuse that has a rear refuse discharge opening including a tailgate against which the refuse is packed and a forward refuse receiving opening which connects with a charging hopper disposed forward of the storage enclosure. The body is further designed with a substantially full width walled charging hopper that permits the addition of a set of front loader arms to the body so that it can be implemented as a front loading or side loading or even a combination front and side loading collection vehicle body.

A relatively high speed variable stroke cycle packer-ejector panel mechanism having a programmable operation is provided that can be operated using a packing cycle selected from a plurality of available packing stroke cycles. A communication system is provided between the vehicle loading system and the packer-ejector mechanism such that the packer-ejector panel operation can be fully programmed, for example, to count the number and density (frequency) of loading cycles of a side-loading arm dumping containers into the charging hopper to determine, for example, when and whether a quick shorter (possibly a sweep) cycle or a full cycle packing stroke should be used. Normally, after a selected number of quick fractional cycles, a full packing cycle is used to clear the charging hopper. Packer cycle time, in one model is approximately eight seconds for a sweep cycle or sixteen seconds for a packing cycle. The sweep cycle time is faster than the loading cycle time on a side arm container handling system and the full cycle is less than the cycle time of the front arms so that the loading device cannot tip a container behind the packer panel. This allows rapid loading while eliminating the need for a follower panel system in the design of the packer panel system. Followers have long been an easily damaged, high maintenance item in refuse packers and the ability to operate without a follower offers a significant advantage.

A pair of crossing telescoping cylinders are provided in one preferred embodiment to operate the packer-ejector panel mechanism which provide a full retract, quick sweep cycle pack, a full cycle pack and assume a fully extended position to eject all the material from the storage enclosure without the need for tipping the truck body. As indicated, operation may be fully programmable and microprocessor controlled.

The container handling device of a side-loading embodiment includes a lateral reaching device such as an extendable telescoping boom device or the like which carries a container tipper arm system of narrow profile. The narrow profile eliminates the need to mount the arm in an offset position in relation to the boom or recessing the charging hopper to enable the container handling device to be retracted to a position within the confines of the overall width of the vehicle when the container handling device is in the fully retracted position. This further enables the tipping mechanism to empty refuse containers generally in the center of the charging hopper which also improves side-to-side packed payload distribution in the operation of the system. The preferred arm is further designed to minimize the number of moving components and, in addition, incorporates an offset linkage which allows the container to remain generally quite high in the tipping cycle.

BRIEF DESCRIPTION OF THE DRAWINGS

In the drawings wherein like numerals depict like parts throughout the same.

DETAILED DESCRIPTION

The specific embodiments illustrated and described in the detailed description of this specification are intended to serve as examples only and are not intended to limit the scope of the inventive concepts in any way. The features of the invention may be manifested in a variety of forms yet remain within the confines of the intended scope of the invention.

Figure 1A:
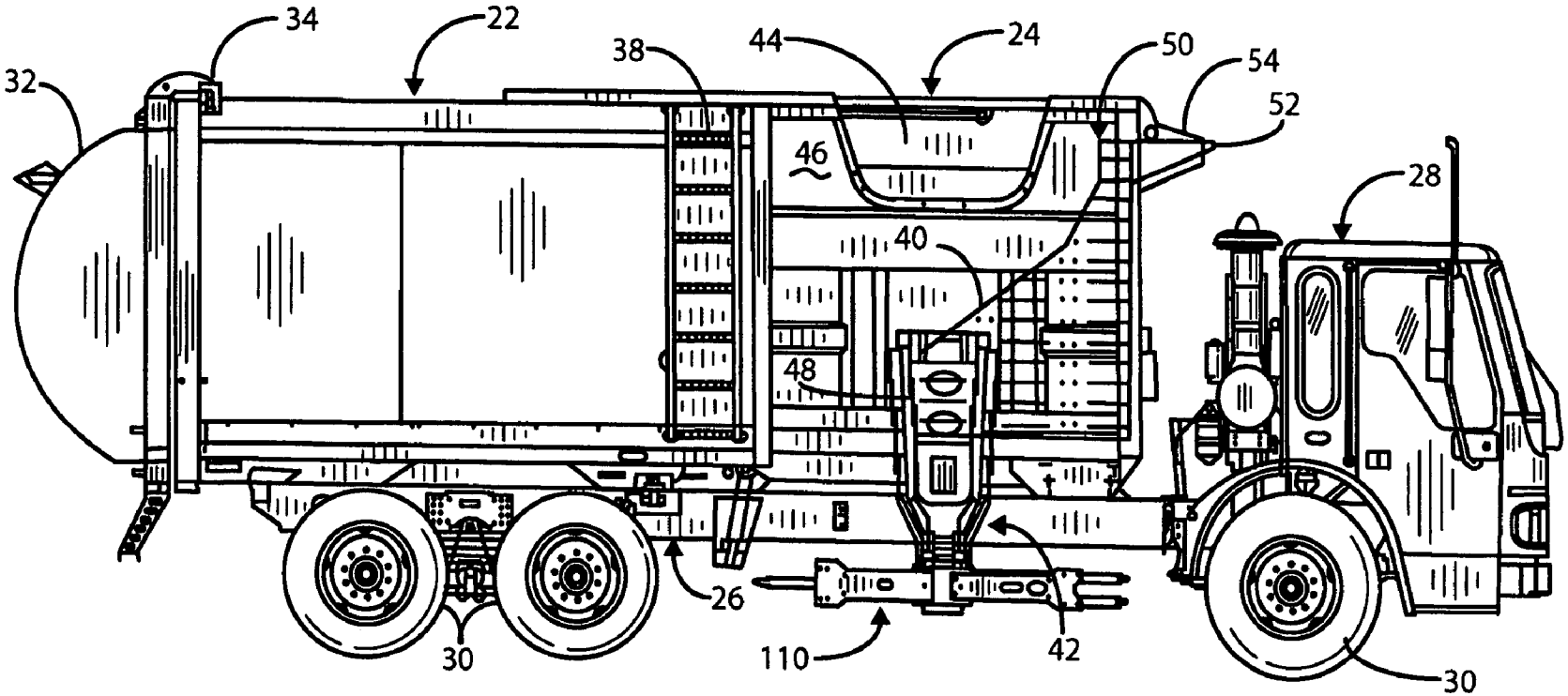
FIGS. 1(*a*)–1(*d*) represent side elevational views depicting a side-loading version of a refuse collection vehicle as an embodiment of the refuse collection body of the invention showing the packer-ejector mechanism in four different, successive stages or positions including a home or fully retracted position (1(*a*)); sweep stroke packing position (1(*b*)); packing stroke position (1(*c*)); and full eject phase (1*d*)
Figure 1B:
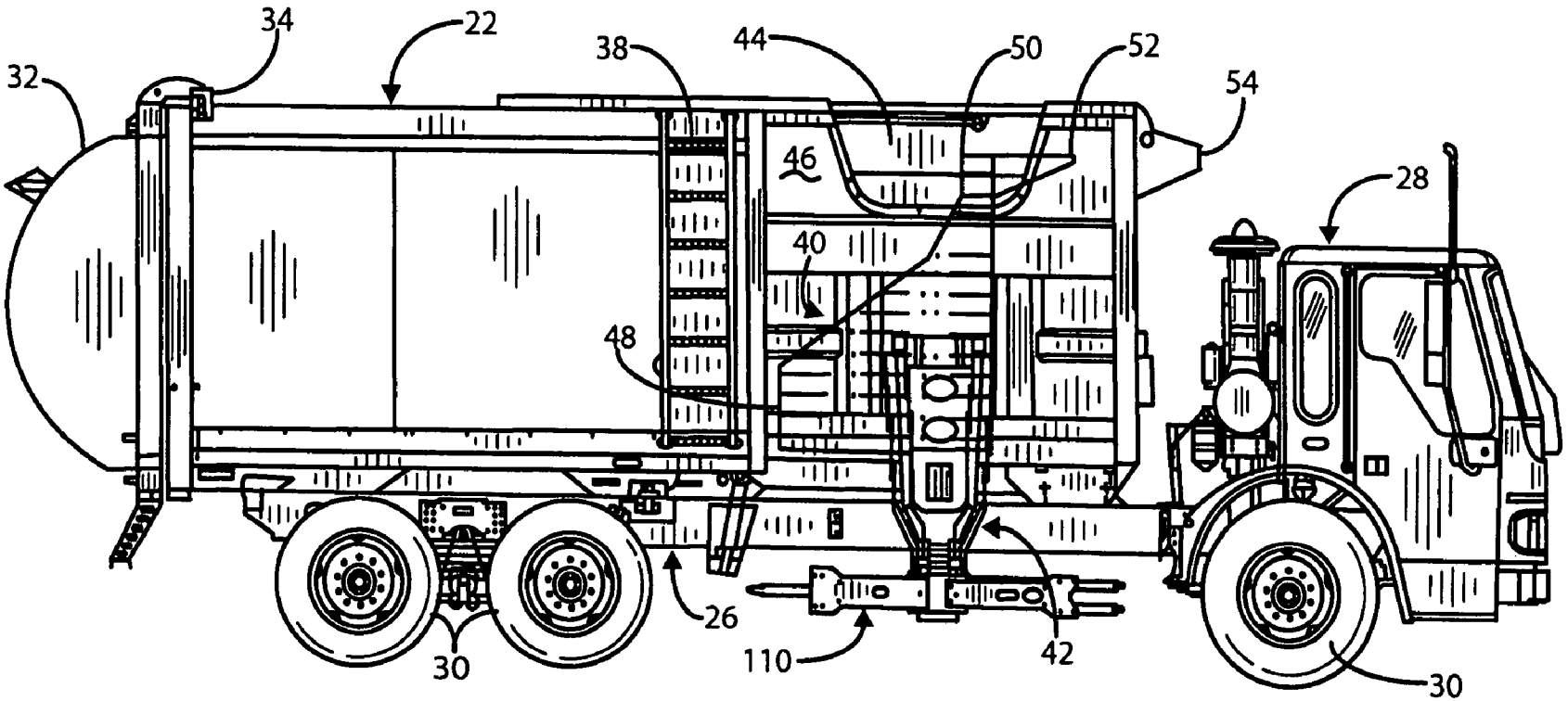
Figure 1C:
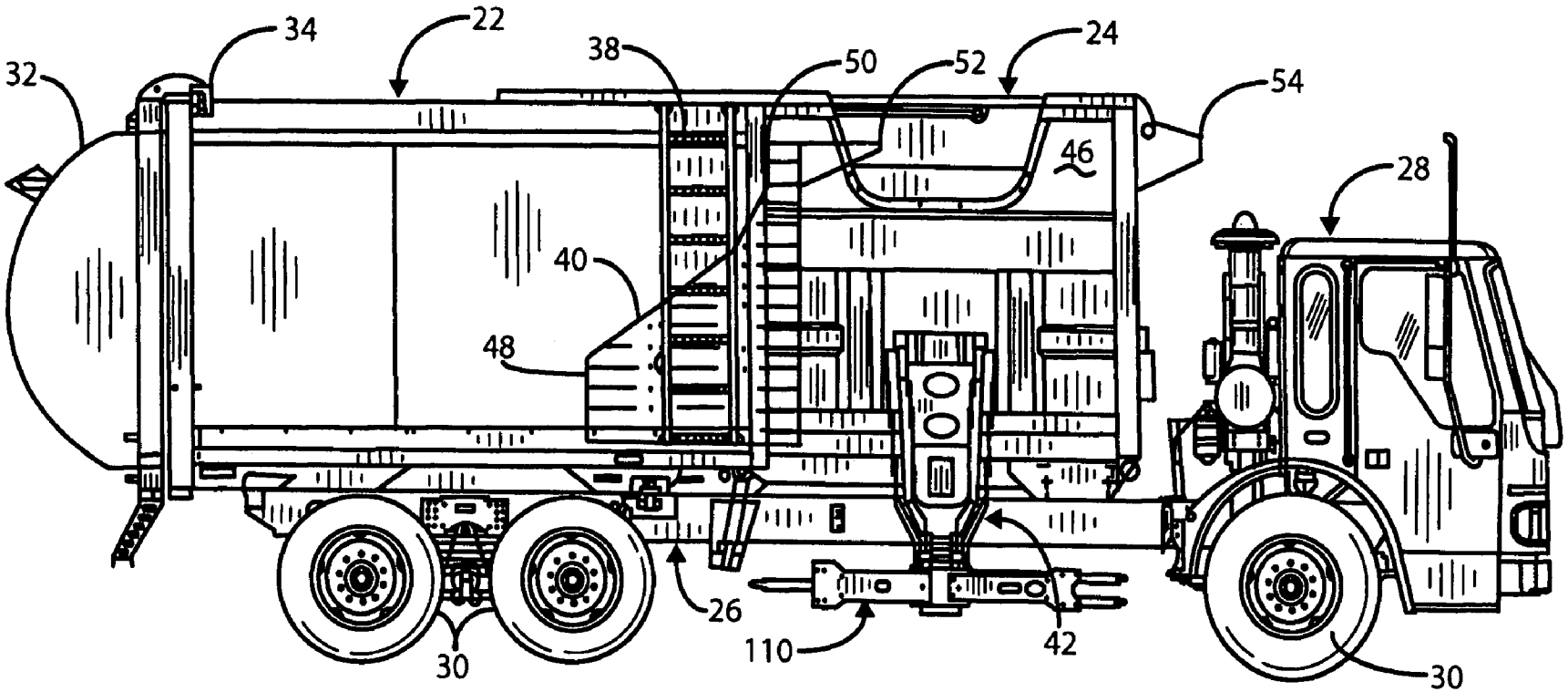
Figure 1D:
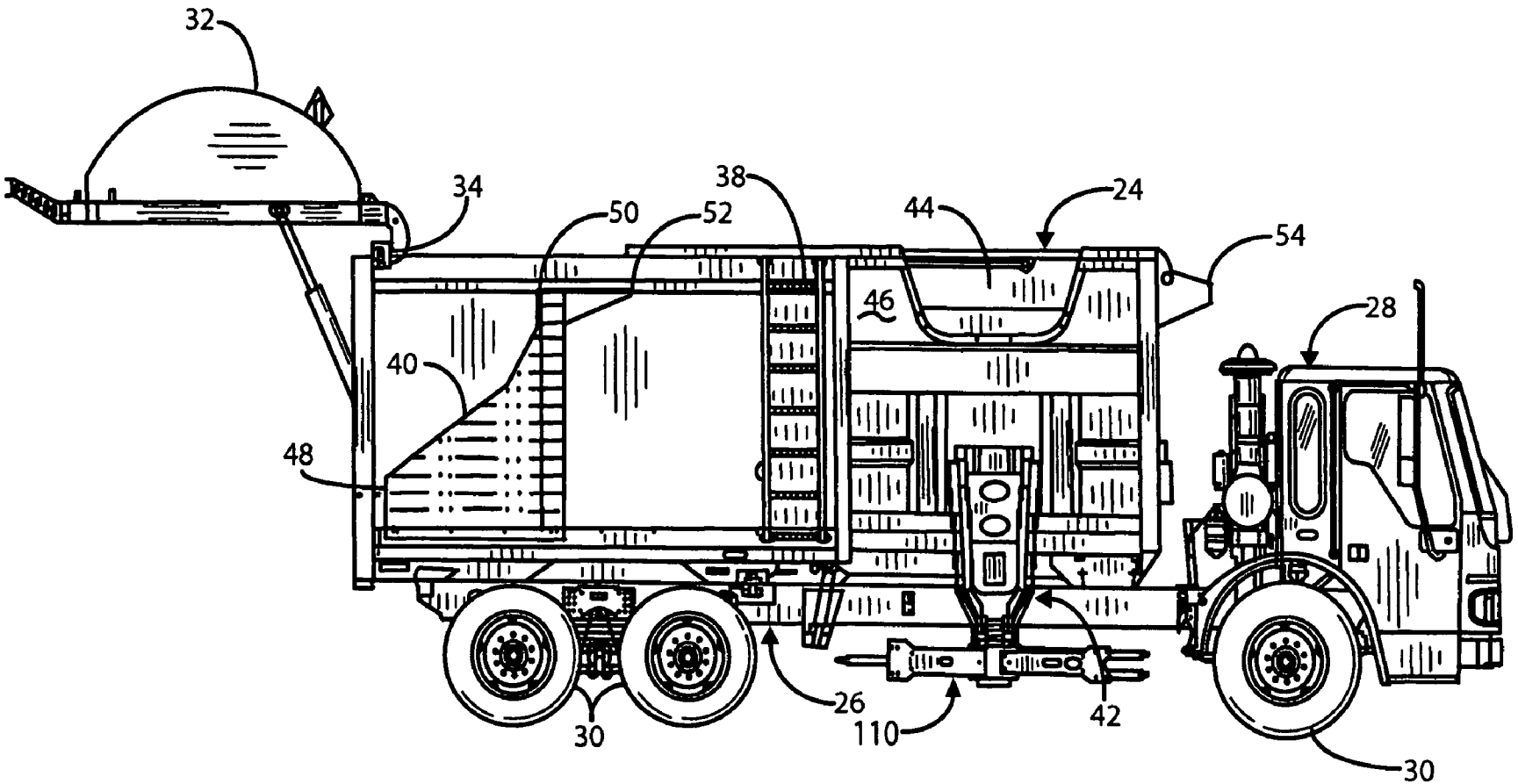
Figure 2A:
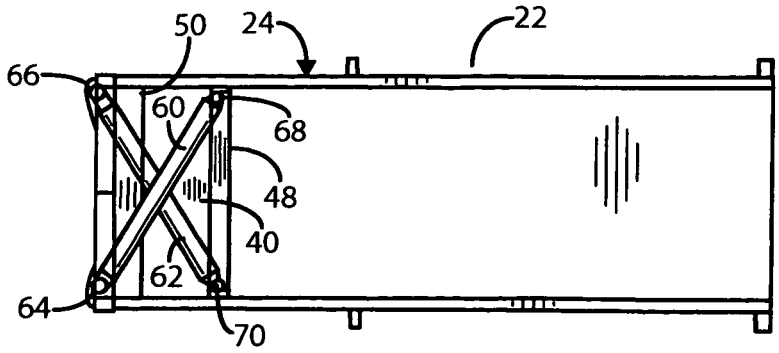
FIGS. 2(*a*)–2(*c*) depict a top schematic views of the crossing cylinder packer-ejector operating system in three of the stages including the fully retracted or home position (2(*a*)); a packing stroke position (2(*b*)); and a full eject position (2(*c*))
Figure 2B:
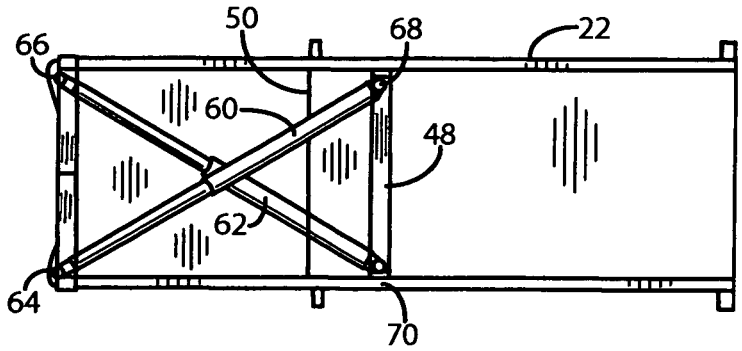
Figure 2C:
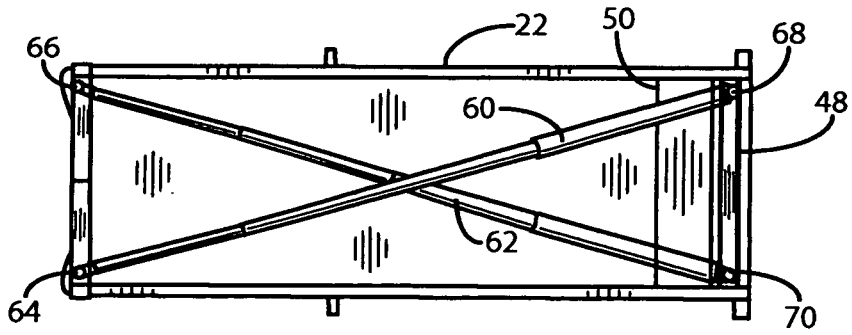
Figure 3A:
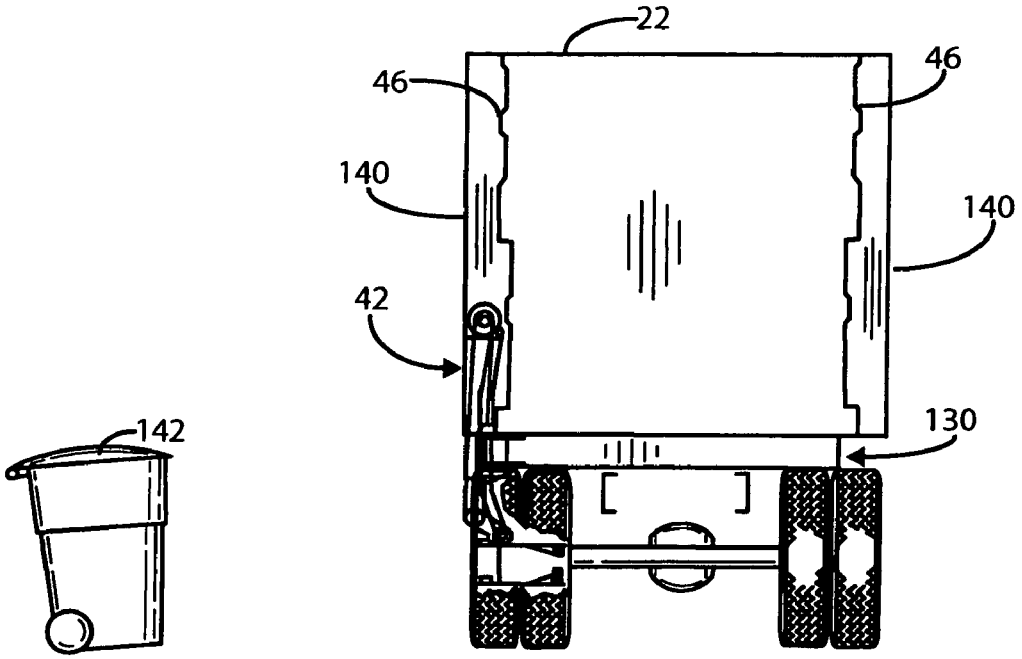
FIGS. 3(*a*)–3(*f*) depict successive stages of a container tipping operation utilizing the side-loader system of FIGS. 1(*a*)–1(*d*)
Figure 3B:
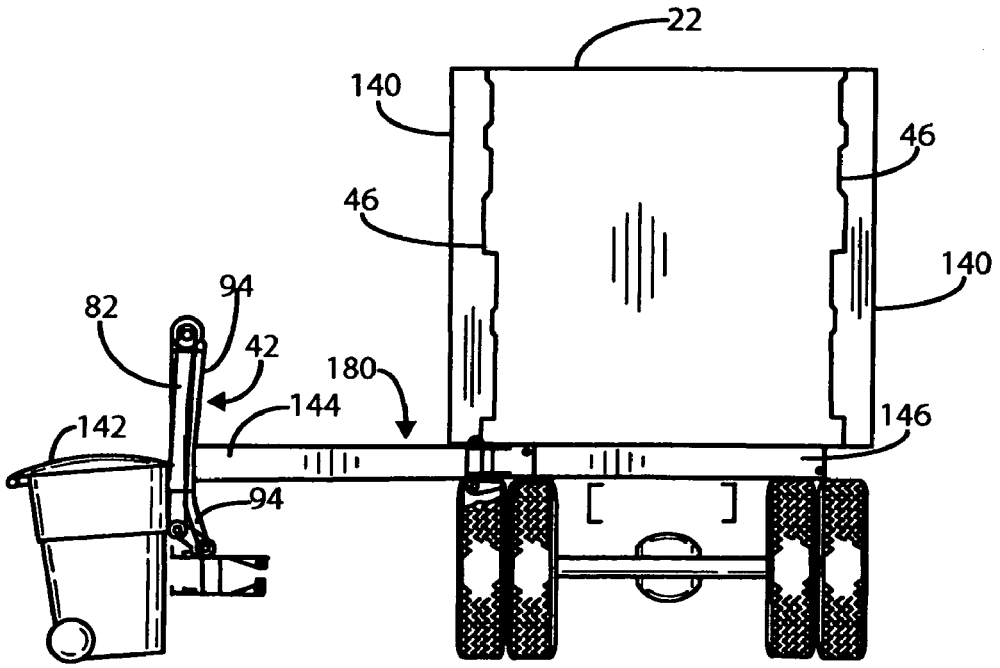
Figure 3C:
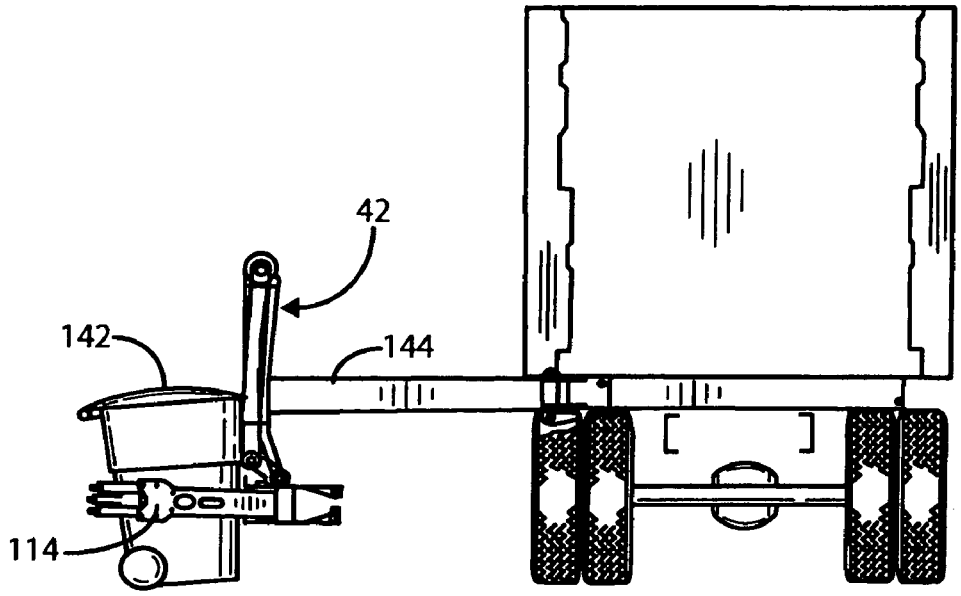
Figure 3D:
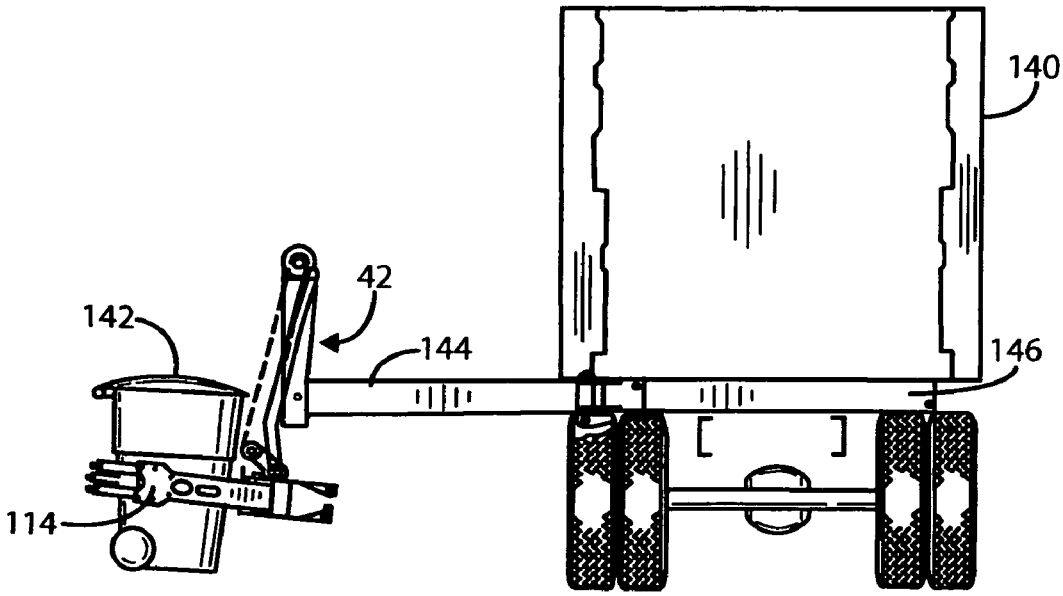
Figure 3E:
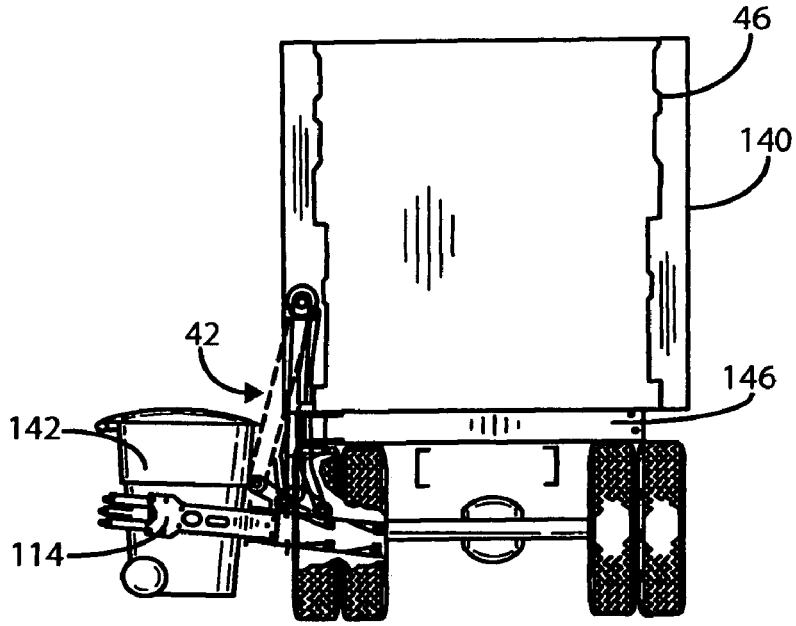
Figure 3F:
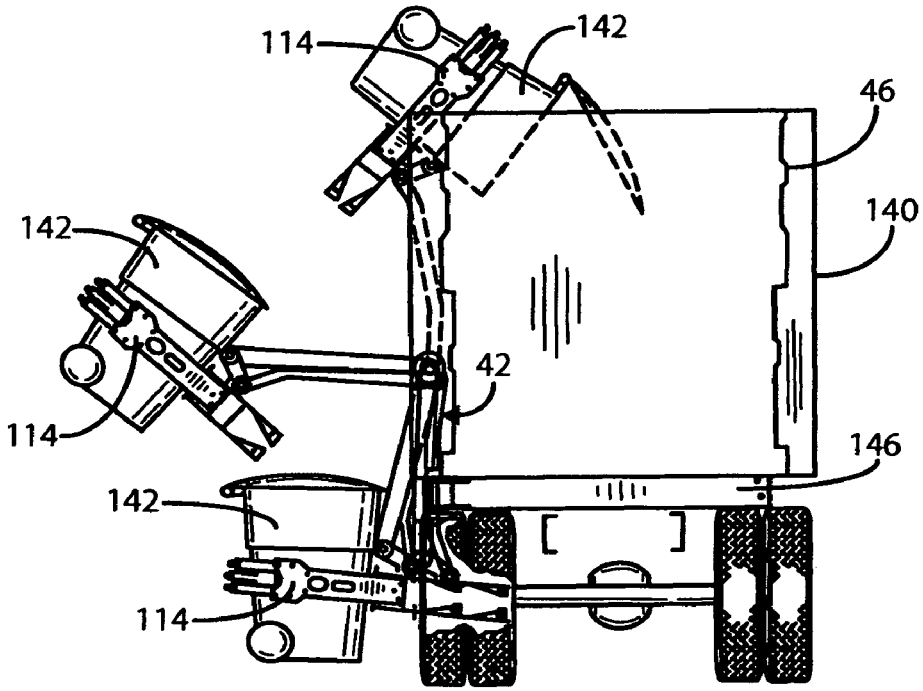

Given the above, FIGS. 1(*a*)–1(*d*) depict a side-loading refuse truck illustrating successive stages of refuse packing and ejection. FIGS. 2(*a*)–2(*c*) are top schematic views depicting the operation of the packing and ejecting cylinders. The refuse truck, generally at 20, includes a large hollow refuse storage enclosure 22 connected to or integral with a receiving or charging hopper 24, both of which are mounted on a heavy-duty truck chassis 26 which also carries a conventional cab 28 and is mounted on wheels 30 in a conventional manner. The storage enclosure 22 is provided with a full-size rear discharge opening closed by a heavy tailgate 32 which pivots vertically from a pair of spaced top hinges, one of which is shown at 34. The tailgate is typically opened by a pair of hydraulic cylinders, one of which is shown at 36 (FIG. 1(*d*)). An access ladder is shown at 38. The tailgate 32 is in the shape of heavy-duty pressure vessel member and refuse compacted into the storage enclosure 22 is pushed up against the tailgate when compacted, thus the tailgate must withstand the full compaction pressure. The refuse storage enclosure further includes a large forward refuse receiving opening (not shown) which connects with the charging hopper and extends across the full width of the charging hopper.

A packer-ejector panel 40 is provided to pack refuse deposited in the charging hopper by a side-loading container handling device generally at 42 which is adapted to tip containers at about the mid point of the charging hopper 24 where a recess 44 is located in the relatively high sidewall 46 of charging hopper 24. As will be discussed, the relatively high sidewalls 46 of charging hopper 24 are designed to optionally provide for front loading of relatively large boxes.

In FIG. 1(*a*), the packer-ejector panel mechanism is shown with the packer panel in the fully retracted or home position. A low profile generally vertical packer blade is shown at 48 and the forward top corner of the packer-ejector panel mechanism is shown at 50. In the fully retracted position, a top end rear nose of the panel at 52 is nested in a top hopper recess 54 thereby preventing material from lodging behind the packer-ejector panel mechanism during loading.

In FIG. 1(*b*), the packer-ejector panel mechanism is depicted as having been advanced to a quick stroke or sweep-cycle packing position also referred to as a hopper sweep position which clears the hopper but does not involve a full packing stroke which extends into the storage enclosure.

FIG. 1(*c*) shows the packer-ejector panel in the full packing position where it penetrates the front of the storage enclosure 22 after a packing stroke clears the contents of the charging hopper 24. In FIG. 1(*d*), the full eject position is disclosed with the tailgate raised using a pair of cylinders 36 and the packer panel 40 having been advanced to the end of the storage enclosure 22 thereby expelling all of the contents.

FIGS. 2(*a*)–2(*c*) depict schematic top views of the position of the packer-ejector panel mechanism. As seen in the figures, the packer-ejector panel mechanism includes a pair of crossing telescoping hydraulic cylinders 60 and 62, both of which are pivotally mounted both to the forward end of the truck body as at 64, 66, respectively, and to the packer-ejector panel as at 68, 70, respectively. FIG. 2(*a*) represents the system in the fully retracted or home position as with FIG. 1(*a*). FIGS. 2(*b*) and 2(*c*) represent, respectively, a full pack and a full eject position. In the fully retracted or home position, the cylinders 60 and 62 are fully retracted or collapsed and this determines the minimum allowable packer-ejector panel depth.

The packer-ejector panel mechanism is depicted with the cylinders having fixed rod ends and traveling cylinder or blind ends. Hydraulic fluid is supplied and returned from the rod end of each cylinder. While not restrictive or limiting, this is the preferred arrangement as it is the most efficient.

As indicated, the side-loading container handling device 42 is preferably one exhibiting a narrow retracted profile, together with compact lift and dump characteristics. This enables the use of a full-width charging hopper which improves packed load distribution and enables front loading and enables straight-on mounting to a laterally extending device such as a boom in which no offset is required. This also enables cart tipping toward the center of the charging hopper for more uniform loading of the storage enclosure.

Figure 4:
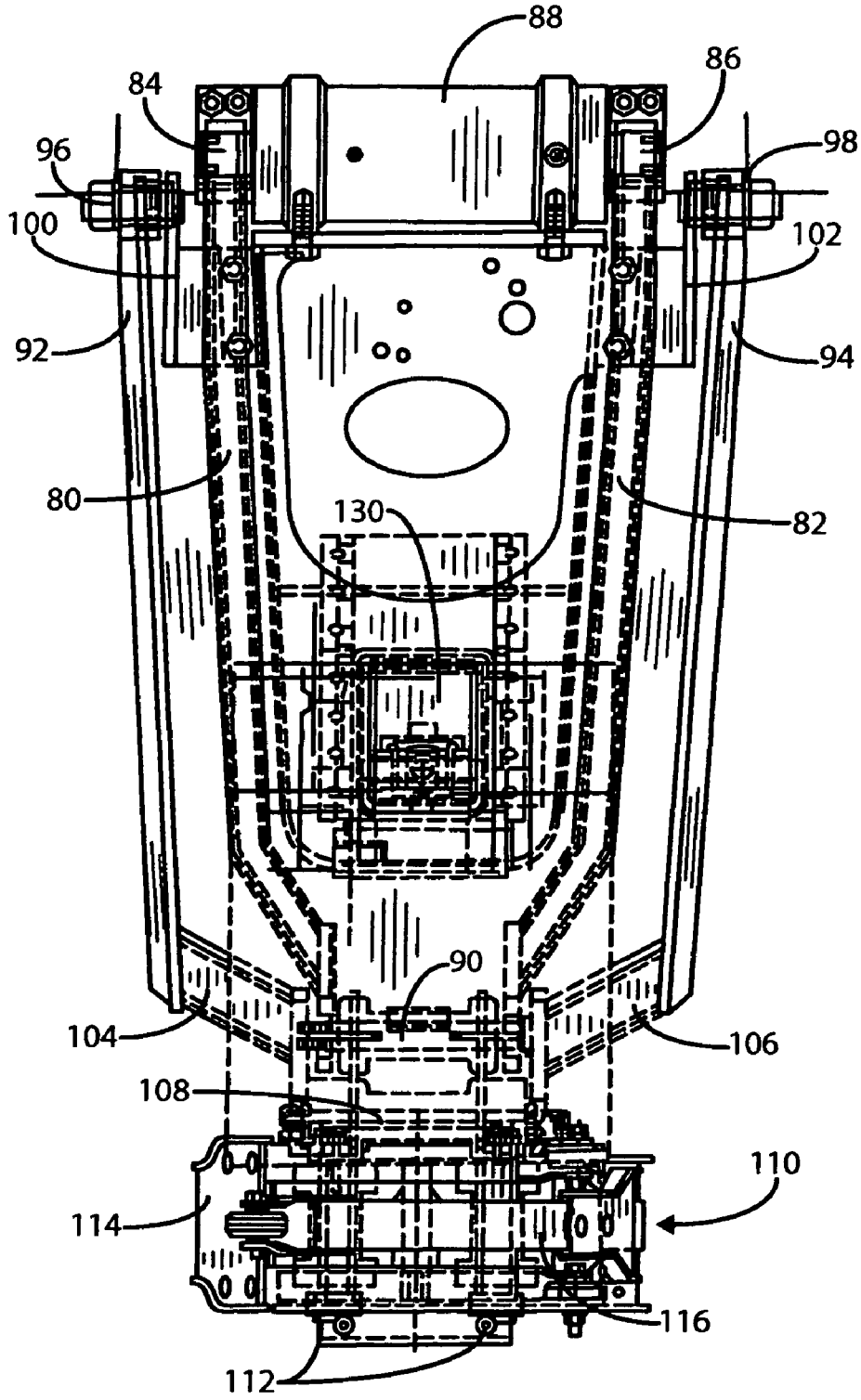
FIG. 4 is a front view of a side loading container handling device suitable for the refuse collection vehicle of the invention.
Figure 5:
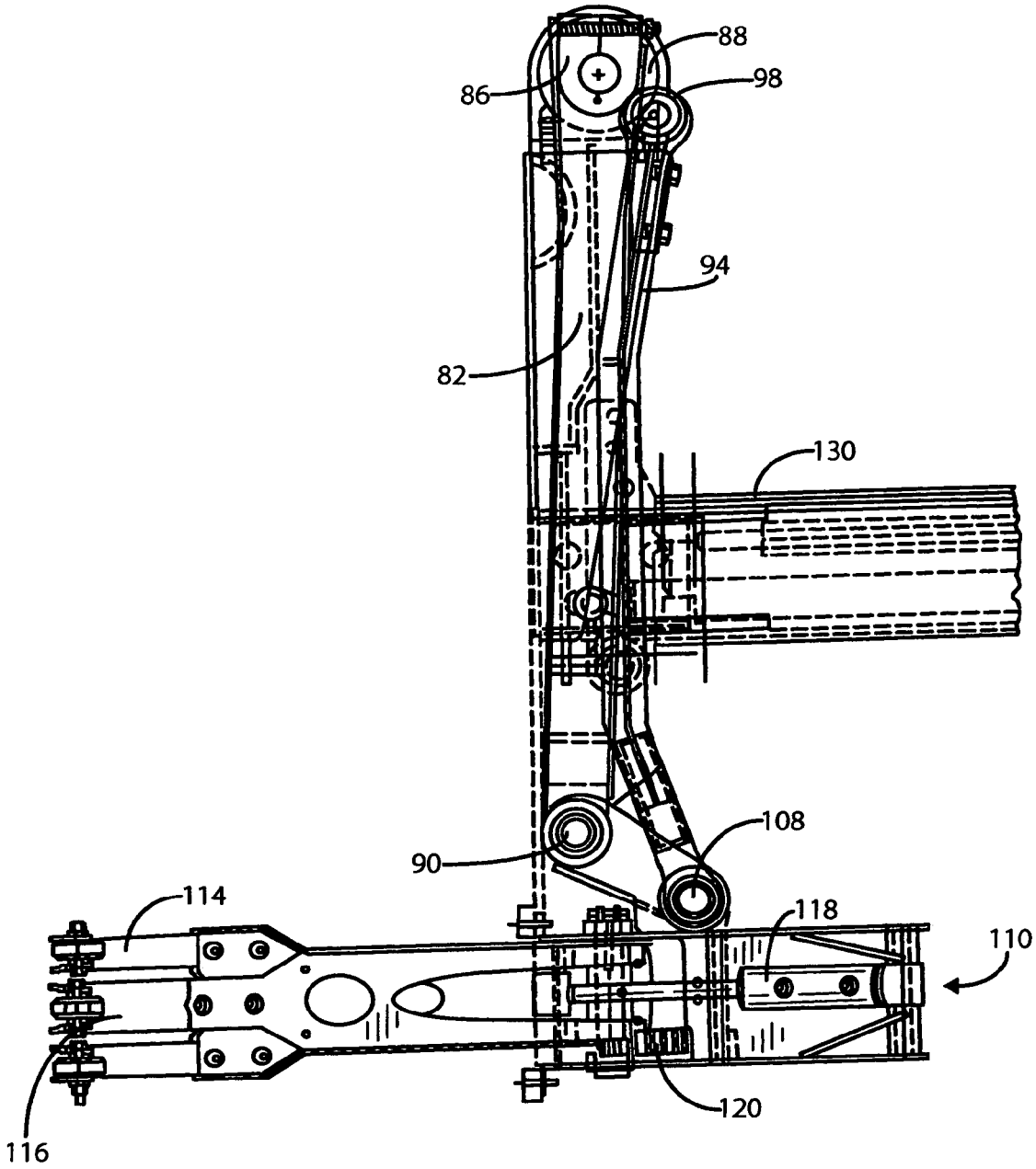
FIG. 5 is a side view of the side loading container handling device of FIG. 4.

As seen best in the front and side elevational views of FIGS. 4 and 5, the side loading container handling device 42 includes a pair of spaced main arms 80, 82 having upper ends, respectively, mounted to pivot in unison as by being clamped to the opposed output shaft end of a double-ended rotary actuator 88 as at 84 and 86. The actuator 88 may be a hydraulic motor device as are well known. The arms have lower ends linked together by a common link pin 90 with suitable journaling for relative rotation. A pair of link arms are provided outside and generally flanking the main arms at 94. The link arms have upper ends mounted and suitably journaled to pivot from mounts as at 96, 98 which are connected to respective flanges 100, 102 which, in turn, are connected to the container handling device structure. The lower ends of the link arms include connectors 104, 106, respectively, which are connected in suitably journaled fashion to a common link arm pin 108, which is offset from the main arm pin 90 to provide an offset linkage. Linkage pins 90, 108 are fixed in location relative to each other and with the construction shown, provide a narrow profile arm.

A grabber system 110 is connected to the lower portion of the container handler arm system as by mounting bolt/pivot joints 112. The grabber system is of a type clearly illustrated and described in U.S. Pat. No. 5,769,592 which is assigned to the same assignee as the present application and which is hereby incorporated by reference in its entirety herein for any purpose. The system is basically a system with dual converging arms including a split two-finger arm 114 and single central finger arm 116. The system is operated by a single cylinder 118 and a pair of enmeshing gears, one of which is shown at 120. FIGS. 4 and 5 show the grabber device 110 in the grabbing or container encircling position.

The arm system is further shown as being connected to the end of the extendable member of a telescoping boom device at 130 which provides lateral range for the grabber system. The arm is further designed to pivot in a vertical plane utilizing the rotary actuator 88 with the offset linkage helping to maintain a container in a substantially upright disposition until near the end of a tipping arc.

FIGS. 3(*a*)–3(*f*) illustrate side-loading steps utilizing the container handling device of the side-loading embodiment of the invention as schematic representations. FIG. 3(*a*) shows the storage enclosure body dimensions at 140 with the outline of the sides 46 of the associated charging hopper depicted as being nearly the full width of the truck body. The container handling system 42 is also shown in the totally retracted position as in FIGS. 1(*a*)–1(*d*). Note that it fits within the confines of the dimensions of the outside of the truck shown at 140. A refuse container to be addressed is shown at 142.

In FIG. 3(*a*), the truck has just pulled up alongside the container 142 and is ready to begin the loading cycle. In FIG. 3(*b*), we see the telescoping portion 144 of the boom has been extended relative to a stationary portion 146 and the container 142 has been reached. In FIG. 3(*c*), the container 142 has been captured by the grabber system 110. In FIG. 3(*d*) we see that the container 142 has been partially lifted for ground clearance during the retraction of the boom in the retrieval step. FIG. 3(*e*) shows the container 142 in the retrieved position before the lift and tip operation. FIG. 3(*f*) shows the lift and tip or dump cycle in which the container is raised and tipped through the top side of the charging hopper. The steps of 3(*b*) through 3(*f*) are then reversed to return the now-empty container 142 to its original location.

Figure 6:
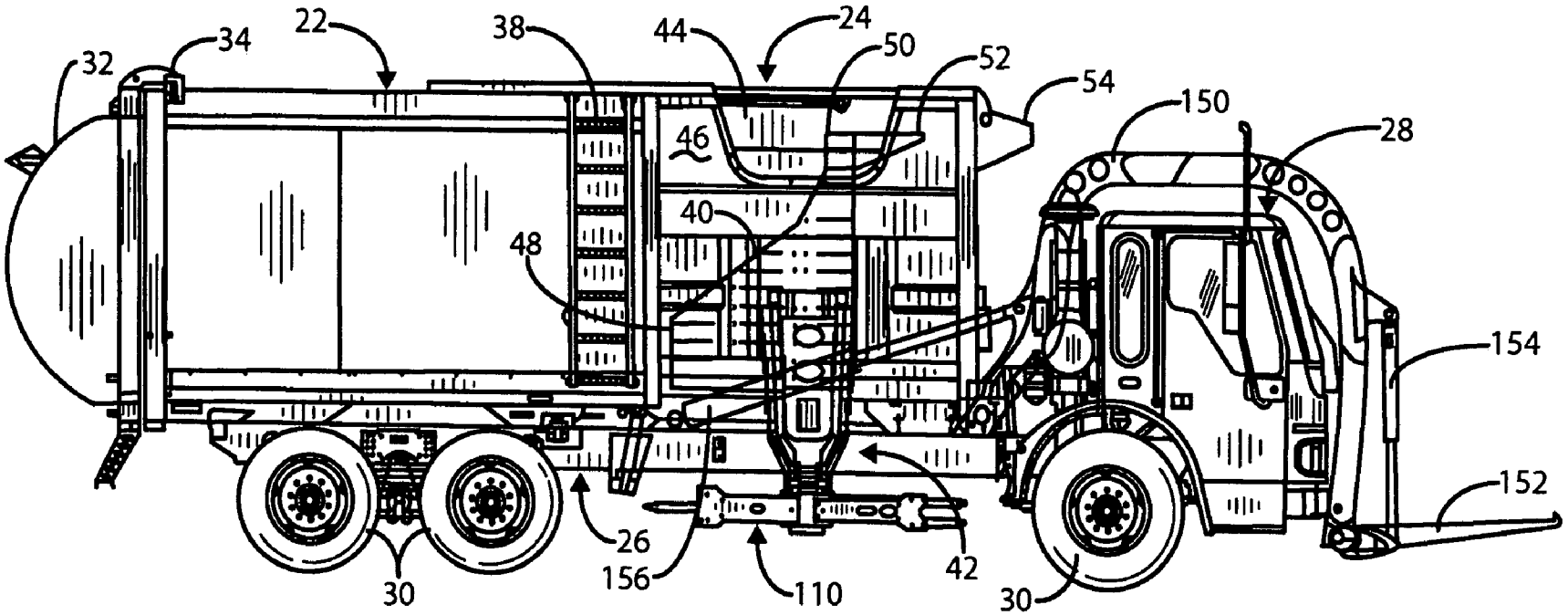
FIG. 6 is a side elevational view of an alternate embodiment of the refuse collection vehicle of the invention including a front loading aspect.

FIG. 6 depicts a refuse vehicle similar to that shown in FIG. 1(*b*) with the addition of a front loading system. The system could also be a front-loading only system with the side-loading container handler removed. One side of the front loading system is shown in FIG. 6, it being understood that an identical set of coordinated, connected container manipulating devices exist on the opposite side of the vehicle. The front loading system is conventional and includes a pair of lift arms, one of which is shown at 150, connected to a pair of pivoting lift forks, one of which is shown at 152, which are pivoted by cylinders as at 154. The lift arms are themselves operated by a pair of cylinders 156 in a conventional manner. The full width, high-sided charging hopper is designed to accommodate the contents of boxes typically lifted and emptied by front loading systems in addition to having the ability to be side loaded, as previously discussed.

An important aspect of the present invention lies in the fact that the packer-ejector mechanism may be fully programmable, its operation coordinated with the operation of the loading devices as desired. The system can be programmed, for example, to track the number of loading cycles of a side-loading arm dumping containers into the charging hopper to determine when and what type of a compacting stroke should be used. The use of a quick shorter half or sweep stroke after each container is dumped allows the system to easily keep up with a route having a dense container population. This enables a full packing stroke to be required only after perhaps four or five containers have been emptied. The sweep stroke is quite fast, possibly eight seconds or less so that the packer-ejector mechanism can be fully retracted faster than a repeat container dumping operation can be performed thereby advantageously precluding the need for a follower. The full packing stroke is also relatively rapid, perhaps sixteen seconds-long. The use of the system in a front loading mode is also convenient for the full packing cycle inasmuch as the loading cycle for a front loading vehicle mechanism consumes additional time allowing the full packing cycle to be completed.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

What is claimed is:

1. A refuse collection vehicle for loading, compacting, transporting and ejecting refuse materials comprising:

(a) a hollow refuse storage enclosure for containing compacted refuse having a forward refuse receiving opening, and a rear refuse discharge opening closed by a tailgate;

(b) a charging hopper disposed forward of said storage enclosure for receiving refuse from refuse containers, said charging hopper having sidewalls and a floor and being in communication with said refuse receiving opening of said storage enclosure;

(c) a followerless packer-ejector panel mechanism for moving refuse materials deposited in said charging hopper from said charging hopper into said storage enclosure, packing said refuse materials into said storage enclosure and fully ejecting said refuse materials from said storage enclosure without the need of a follower panel;

(d) one or more container handling devices including at least one side loading container handling device wherein said side loading container handling device further contains a container lift and dump mechanism having a pair of spaced main arms outwardly flanked by a pair of link arms, said main arms being connected to be pivoted at a fixed end and journaled on a main arm common pin at a free end, said link arm being journaled to said lift and dump mechanism at a fixed end and journaled on a link arm common pin at a free end, said link arm common pin being located at a fixed offset from said main arm common pin and a container grabbing device having opposed arms mounted in fixed relation to said fixed offset of said pins such that in a lowered stored position said main arms and said link arms align to provide a narrow profile for emptying containers into said charging hopper;

(e) control system for controlling the operation of said packer-ejector panel in relation to said container handling device; and (f) wherein said control system includes controls to provide said ejector panel mechanism with a plurality of selectable packing stoke cycles of different lengths and time durations in the packing mode including a packing stroke cycle of shorter time duration than an emptying cycle of a corresponding container handling device such that said packer-ejector panel returns to a fully forward position before a new emptying cycle can allow deposit of material behind said packer-ejector panel.

2. A vehicle as in claim 1 wherein said packing stroke cycles include at least a short sweep cycle and a full packing cycle.

3. A vehicle as in claim 2 wherein said control system includes control devices to select said packing stroke cycle based on a count of loading operations.

4. A vehicle as in claim 3 wherein said packing stroke cycle is microprocessor controlled.

5. A vehicle as in claim 1 wherein said control system includes control devices to select a packing stroke cycle based on said corresponding container handling device in use being a front-loading or a side-loading device.

6. A vehicle as in claim 1 including a truck chassis.

7. A vehicle as in claim 1 wherein said one or more container handling devices includes both a side-loading container handling device and a front-loading device.

8. A vehicle as in claim 1 wherein said arm is mounted from a laterally extendable device.

9. A vehicle as in claim 8 wherein said laterally extendable device is a telescoping device.

10. A vehicle as in claim 1 wherein said side loading container handling system does not extend beyond the width of said collection vehicle when said lift and dump device is stowed next to said charging hopper.

11. A vehicle as in claim 1 wherein said main arms of said container lift and dump mechanism of said side loading container handling system are pivoted by a double-ended hydraulic rotary actuator.

12. A side-loading refuse collection vehicle for loading, compacting, transporting and ejecting refuse materials comprising:

(a) a hollow refuse storage enclosure for containing compacted refuse having a forward refuse receiving opening, and a rear refuse discharge opening including a tailgate;

(b) a charging hopper disposed forward of said storage enclosure for receiving refuse from refuse containers, said charging hopper having sidewalls and a floor and being in communication with said refuse receiving opening of said storage enclosure;

(c) a packer-ejector panel mechanism for moving refuse materials deposited in said charging hopper from said charging hopper into said storage enclosure, packing said refuse materials into said storage enclosure and fully ejecting said refuse materials from said storage enclosure;

(d) a side-loading container handling system mounted from said vehicle including a container lift and dump mechanism having a pair of spaced main arms outwardly flanked by a pair of ink arms, said main arms being connected to be pivoted at a fixed end and journaled on a main arm common pin at a free end, said link arms being journaled to said lift and dump mechanism at a fixed end and journaled on a link arm common pin at a free end, said link arm common pin being located at a fixed offset from said main arm common pin and a container grabbing device having opposed arms mounted in fixed relation to said fixed offset of said pins such that in a lowered stored position said main arms and said link arms align to provide a narrow profile.

13. A vehicle as in claim 12 wherein said packing stroke cycles include at least a short sweep cycle and a full cycle.

14. A vehicle as in claim 13 wherein said control system includes control devices to select said packing stroke cycle based on a count of loading operations.

15. A vehicle as in claim 12 including a truck chassis.

16. A vehicle as in claim 12 including a front loading container handling device.

17. A vehicle as in claim 12 wherein said arm is mounted from a laterally extendable device.

18. A vehicle as in claim 17 wherein said laterally extendable device is a telescoping device.

19. A vehicle as in claim 12 wherein said side loading container handling system does not extend beyond the width of said collection vehicle when said lift and dump device is stowed next to said charging hopper.

20. A vehicle as in claim 12 wherein said main arms of said container lift and dump mechanism of said side loading container handling system are pivoted by a double-ended hydraulic rotary actuator.

21. A side loading refuse collection vehicle for loading, compacting, transporting and ejecting refuse materials comprising a side-loading container handling system mounted from said vehicle including a container lift and dump mechanism having a pair of spaced main arms outwardly flanked by a pair of link arms, said main arms being connected to be pivoted at a fixed end and journaled on a main arm common pin at a free end, said link arms being journaled to said lift and dump mechanism at a fixed end and journaled on a link arm common pin at a free end, said link arm common pin being located at a fixed offset from said main arm common pin and a container grabbing device having opposed arms mounted in fixed relation to said fixed offset of said pins such that in a lowered stored position said main arms and said link arms align to provide a narrow profile.

22. A vehicle as in claim 21 including a truck chassis.

23. A vehicle as in claim 21 wherein said arm is mounted from a laterally extendable device.

24. A vehicle as in claim 23 wherein said laterally extendable device is a telescoping device.

25. A vehicle as in claim 21 wherein said side loading container handling system does not extend beyond the width of said collection vehicle when said lift and dump device is stowed next to said charging hopper.

26. A vehicle as in claim 21 wherein said main arms of said container lift and dump mechanism of said side loading container handling system are pivoted by a double-ended hydraulic rotary actuator.

* * * * *